US009234647B2

(12) United States Patent
Gabrius et al.

(10) Patent No.: US 9,234,647 B2
(45) Date of Patent: Jan. 12, 2016

(54) LIGHT ENGINE

(71) Applicant: ABL IP Holding LLC, Conyers, GA (US)

(72) Inventors: Algimantas J. Gabrius, Oxford, GA (US); Douglas Dewayne Grove, Grayson, GA (US); Jon D. Hinnefeld, Conyers, GA (US); Joseph J. Onda, Conyers, GA (US); Marvin L. Otterson, Oxford, GA (US); Carl Jason Schoeneberg, Decatur, GA (US)

(73) Assignee: ABL IP Holding LLC, Conyers, GA (US)

( * ) Notice: Subject to any disclaimer, the term of this patent is extended or adjusted under 35 U.S.C. 154(b) by 13 days.

(21) Appl. No.: 13/828,543

(22) Filed: Mar. 14, 2013

(65) Prior Publication Data

US 2013/0294077 A1 Nov. 7, 2013

Related U.S. Application Data

(60) Provisional application No. 61/687,886, filed on May 3, 2012.

(51) Int. Cl.

| | |
|---|---|
| ***F21S 4/00*** | (2006.01) |
| ***F21V 7/00*** | (2006.01) |
| ***F21S 8/02*** | (2006.01) |

(Continued)

(52) U.S. Cl.

CPC ..... *F21V 7/0025* (2013.01); *F21S 8/026* (2013.01); *F21V 7/0083* (2013.01); *F21V 17/002* (2013.01); *F21V 29/713* (2015.01); *F21V 13/04* (2013.01); *F21V 17/12* (2013.01);

(Continued)

(58) Field of Classification Search

CPC ..... F21V 21/30; F21V 5/04; F21V 17/164; F21V 21/00; F21V 5/08; F21V 7/0083; F21V 7/0025; F21V 29/713; F21V 17/002; F21K 9/50; F21K 9/58; F21S 8/026; F21S 8/04; F21S 8/046; B60Q 1/0483

USPC ..... 362/241, 244, 249.03, 249.1, 269

See application file for complete search history.

(56) References Cited

U.S. PATENT DOCUMENTS

| | | | |
|---|---|---|---|
| 3,609,346 | A | 9/1971 | Lund et al. |
| 3,660,651 | A | 5/1972 | Miles |

(Continued)

FOREIGN PATENT DOCUMENTS

| | | |
|---|---|---|
| CA | 2609531 | 11/2006 |

OTHER PUBLICATIONS

Non-Final Office Action for U.S. Appl. No. 13/833,597, mailed Jul. 3, 2014.

(Continued)

*Primary Examiner* — Diane Lee
*Assistant Examiner* — Omar Rojas Cadima
(74) *Attorney, Agent, or Firm* — Kilpatrick Townsend & Stockton, LLP

(57) ABSTRACT

A light engine that includes light emitting diodes mounted on a printed circuit board, which in turn is attached to a heat sink. An optic assembly is positioned over the printed circuit board to direct the emitted light as desired. The light engine can be positioned. within the ceiling within the opening of a mounting frame. In some embodiments, the light engine is retained on the mounting frame such that it can be moved clear of the mounting frame opening.

7 Claims, 17 Drawing Sheets

(51) Int. Cl.

| | |
|---|---|
| ***F21V 17/00*** | (2006.01) |
| ***F21V 29/71*** | (2015.01) |
| *F21V 29/00* | (2015.01) |
| *F21V 13/04* | (2006.01) |
| *F21V 17/12* | (2006.01) |
| *F21Y 101/02* | (2006.01) |
| *F21V 29/77* | (2015.01) |

(52) U.S. Cl.
CPC ..... *F21V 29/20* (2013.01); *F21V 29/77* (2015.01); *F21Y 2101/02* (2013.01)

(56) References Cited

U.S. PATENT DOCUMENTS

| | | | | |
|---|---|---|---|---|
| 3,974,371 | A | 8/1976 | Miles, Jr. | |
| 4,462,068 | A * | 7/1984 | Shadwick | 362/332 |
| 5,207,781 | A * | 5/1993 | Rock | 312/319.1 |
| 5,291,381 | A | 3/1994 | Price | |
| 5,562,343 | A | 10/1996 | Chan et al. | |
| 5,823,664 | A | 10/1998 | Demshki, Jr. et al. | |
| 6,082,878 | A | 7/2000 | Doubek et al. | |
| 6,120,164 | A | 9/2000 | Libin et al. | |
| 6,402,112 | B1 | 6/2002 | Thomas et al. | |
| 6,461,021 | B1 | 10/2002 | Warnecke | |
| 6,471,374 | B1 | 10/2002 | Thomas et al. | |
| 6,491,407 | B1 | 12/2002 | Beadle | |
| 6,634,764 | B2 | 10/2003 | Kotovsky et al. | |
| 6,652,124 | B2 | 11/2003 | Schubert et al. | |
| 6,719,438 | B2 | 4/2004 | Sevack et al. | |
| 6,860,624 | B2 | 3/2005 | Hille et al. | |
| 6,926,427 | B2 | 8/2005 | Tawil et al. | |
| 6,953,270 | B1 | 10/2005 | Richardson | |
| 7,182,496 | B2 | 2/2007 | Ruffin | |
| 7,213,940 | B1 | 5/2007 | Van De Ven et al. | |
| 7,316,359 | B2 | 1/2008 | Beidokhti | |
| 7,431,482 | B1 | 10/2008 | Morgan et al. | |
| 7,476,008 | B2 | 1/2009 | Kay | |
| 7,478,931 | B2 * | 1/2009 | Miletich et al. | 362/364 |
| 7,484,866 | B1 | 2/2009 | Buse | |
| 7,530,705 | B2 | 5/2009 | Czech et al. | |
| 7,559,677 | B1 | 7/2009 | Dupre | |
| 7,618,166 | B1 | 11/2009 | Truax et al. | |
| 7,631,987 | B2 | 12/2009 | Wei | |
| 7,637,636 | B2 | 12/2009 | Zheng et al. | |
| 7,670,028 | B2 | 3/2010 | Liu et al. | |
| 7,703,951 | B2 | 4/2010 | Piepgras et al. | |
| 7,722,227 | B2 | 5/2010 | Zhang et al. | |
| 7,748,868 | B2 | 7/2010 | Patti et al. | |
| 7,753,562 | B2 | 7/2010 | Livesay et al. | |
| 7,766,518 | B2 | 8/2010 | Piepgras et al. | |
| 7,828,464 | B2 | 11/2010 | Wang et al. | |
| 7,832,901 | B2 | 11/2010 | Ladewig | |
| 7,857,492 | B2 * | 12/2010 | Dixon | 362/428 |
| 7,883,237 | B2 | 2/2011 | Zhang et al. | |
| 7,891,624 | B2 | 2/2011 | Dittmer et al. | |
| 7,896,529 | B2 | 3/2011 | Wronski et al. | |
| 7,905,633 | B2 | 3/2011 | Horng et al. | |
| 7,918,587 | B2 | 4/2011 | Hsu et al. | |
| 7,950,834 | B2 | 5/2011 | Dupre | |
| 7,959,332 | B2 | 6/2011 | Tickner et al. | |
| 7,993,034 | B2 | 8/2011 | Wegner | |
| 7,997,763 | B2 | 8/2011 | Giardina et al. | |
| 8,002,425 | B2 | 8/2011 | Russo et al. | |
| 8,021,013 | B2 | 9/2011 | Russo et al. | |
| 8,029,173 | B2 | 10/2011 | Ko | |
| 8,057,082 | B2 | 11/2011 | Seabrook | |
| 8,066,404 | B2 | 11/2011 | Song et al. | |
| 8,066,413 | B2 | 11/2011 | Czech et al. | |
| 8,070,316 | B2 | 12/2011 | Urano et al. | |
| 8,079,740 | B2 | 12/2011 | Huang et al. | |
| 8,100,565 | B2 | 1/2012 | Patti et al. | |
| 8,123,382 | B2 | 2/2012 | Patrick et al. | |
| 8,128,263 | B2 | 3/2012 | Higuchi et al. | |
| 8,182,116 | B2 | 5/2012 | Zhang et al. | |
| 8,215,805 | B2 | 7/2012 | Cogliano et al. | |
| 8,226,278 | B2 | 7/2012 | Ward et al. | |
| 2003/0161153 | A1 | 8/2003 | Patti | |
| 2005/0168986 | A1 * | 8/2005 | Wegner | 362/241 |
| 2006/0250788 | A1 | 11/2006 | Hodge et al. | |
| 2008/0025031 | A1 | 1/2008 | Wronski et al. | |
| 2008/0112171 | A1 | 5/2008 | Patti et al. | |
| 2008/0175003 | A1 | 7/2008 | Tsou et al. | |
| 2008/0266883 | A1 | 10/2008 | Chen | |
| 2009/0046456 | A1 * | 2/2009 | Urano et al. | 362/235 |
| 2009/0086476 | A1 * | 4/2009 | Tickner et al. | 362/231 |
| 2009/0103308 | A1 | 4/2009 | Xu et al. | |
| 2009/0116254 | A1 | 5/2009 | Dupre | |
| 2009/0141494 | A1 * | 6/2009 | Zhang et al. | 362/249.03 |
| 2009/0196053 | A1 | 8/2009 | Ziobro et al. | |
| 2009/0268474 | A1 | 10/2009 | Ward et al. | |
| 2009/0279314 | A1 | 11/2009 | Wu et al. | |
| 2009/0296414 | A1 | 12/2009 | Moriyama et al. | |
| 2010/0002453 | A1 | 1/2010 | Wu et al. | |
| 2010/0014287 | A1 | 1/2010 | Chiang et al. | |
| 2010/0053950 | A1 | 3/2010 | Higuchi et al. | |
| 2010/0085766 | A1 | 4/2010 | Czech et al. | |
| 2010/0110660 | A1 | 5/2010 | Brukilacchio | |
| 2010/0110698 | A1 | 5/2010 | Harwood et al. | |
| 2010/0149822 | A1 | 6/2010 | Cogliano et al. | |
| 2010/0157602 | A1 | 6/2010 | Nichols | |
| 2010/0165643 | A1 | 7/2010 | Russo et al. | |
| 2010/0195327 | A1 * | 8/2010 | Inoue et al. | 362/235 |
| 2010/0246178 | A1 * | 9/2010 | Giardina et al. | 362/249.02 |
| 2011/0031744 | A1 | 2/2011 | Takahashi et al. | |
| 2011/0044038 | A1 | 2/2011 | Mo | |
| 2011/0051410 | A1 | 3/2011 | Liang | |
| 2011/0069501 | A1 | 3/2011 | Chou et al. | |
| 2011/0116276 | A1 | 5/2011 | Okamura et al. | |
| 2011/0134634 | A1 | 6/2011 | Gingrich, III et al. | |
| 2011/0141741 | A1 | 6/2011 | Engstrom et al. | |
| 2011/0164422 | A1 | 7/2011 | Chan | |
| 2011/0182067 | A1 | 7/2011 | Watanabe | |
| 2011/0211346 | A1 | 9/2011 | Ogawa et al. | |
| 2011/0249434 | A1 | 10/2011 | McQuistian et al. | |
| 2011/0317444 | A1 | 12/2011 | Chen | |
| 2012/0051069 | A1 | 3/2012 | Lim | |
| 2012/0069545 | A1 | 3/2012 | Choi et al. | |
| 2012/0320577 | A1 | 12/2012 | Wang | |
| 2014/0085912 | A1 | 3/2014 | David et al. | |

OTHER PUBLICATIONS

Office Action for Canadian Application No. 2,861,719, mailed Oct. 7, 2014.

Notice of Allowance for U.S. Appl. No. 13/833,597, mailed Jan. 30, 2015, 10 pages.

Notice of Allowance for Canadian Application No. CA 2,810,871, mailed Jan. 6, 2015, 1 page.

* cited by examiner

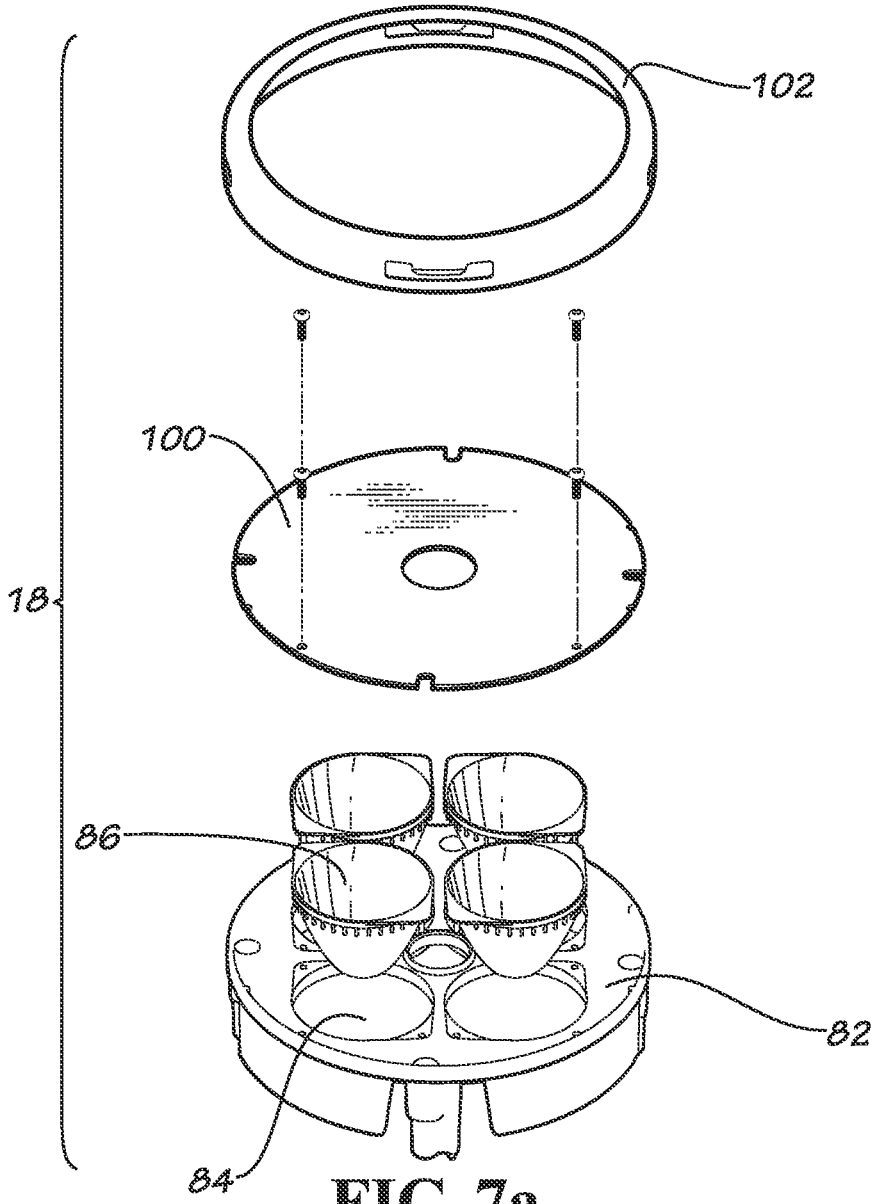
FIG. 7a
FIG. 7b
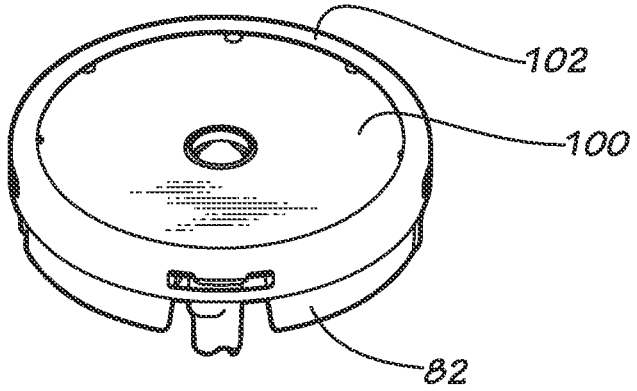

LIGHT ENGINE

CROSS-REFERENCE TO RELATED APPLICATIONS

This application claims the benefit of U.S. Provisional Application No. 61/687,886, filed May 3, 2012, the entirety of which is herein incorporated by reference.

FIELD

Embodiments of the present invention relate to a light engine for recessed positioning within the opening of a pan or mounting frame.

BACKGROUND

Light fixtures for recessed positioning within a ceiling are capable of emitting a single, fixed light distribution. They are not designed to permit adjustment or tailoring of their distribution in the field. Rather, to alter the distribution, the existing fixture must be removed and replaced with. another fixture having the desired distribution. This is a time consuming and costly process.

Moreover, most such fixtures are fixedly secured over the ceiling opening. Servicing the electronic components of the fixture requires full access to the ceiling above the fixture. Therefore, removal and replacement of ceiling components, such as tiles and t-supports, is required to service the electronic components. Exposure to the ceiling environment is less than desirable for a variety of reasons. Environmental concerns, such as asbestos contamination and asbestos removal, become an issue when disturbing the ceiling. Moreover, the area above the ceiling collects dirt and dust which can dislodge during servicing and thereby increase the time and cost of clean-up after installation. Additionally, exposed electrical wiring is common in such areas, which creates a safety hazard for workers during servicing.

SUMMARY

Certain embodiments of the present invention provide a light engine that includes light emitting diodes mounted on a printed circuit board, which in turn is attached to a heat sink. An optic assembly is positioned over the printed circuit board to direct the emitted light as desired. The light engine can be positioned within the ceiling within the opening of a mounting frame. In some embodiments, the light engine is retained on the mounting frame such that it can be moved clear of the mounting frame opening.

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

BRIEF DESCRIPTION OF THE FIGURES

Illustrative embodiments of the present invention are described in detail below with reference to the following drawing figures:

FIG. 7*a* is an exploded view of an alternative embodiment of an optical assembly for use with the light engines contemplated herein.

FIG. 7*b* is a top perspective view of the optical assembly of FIG. 7*a* assembled.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
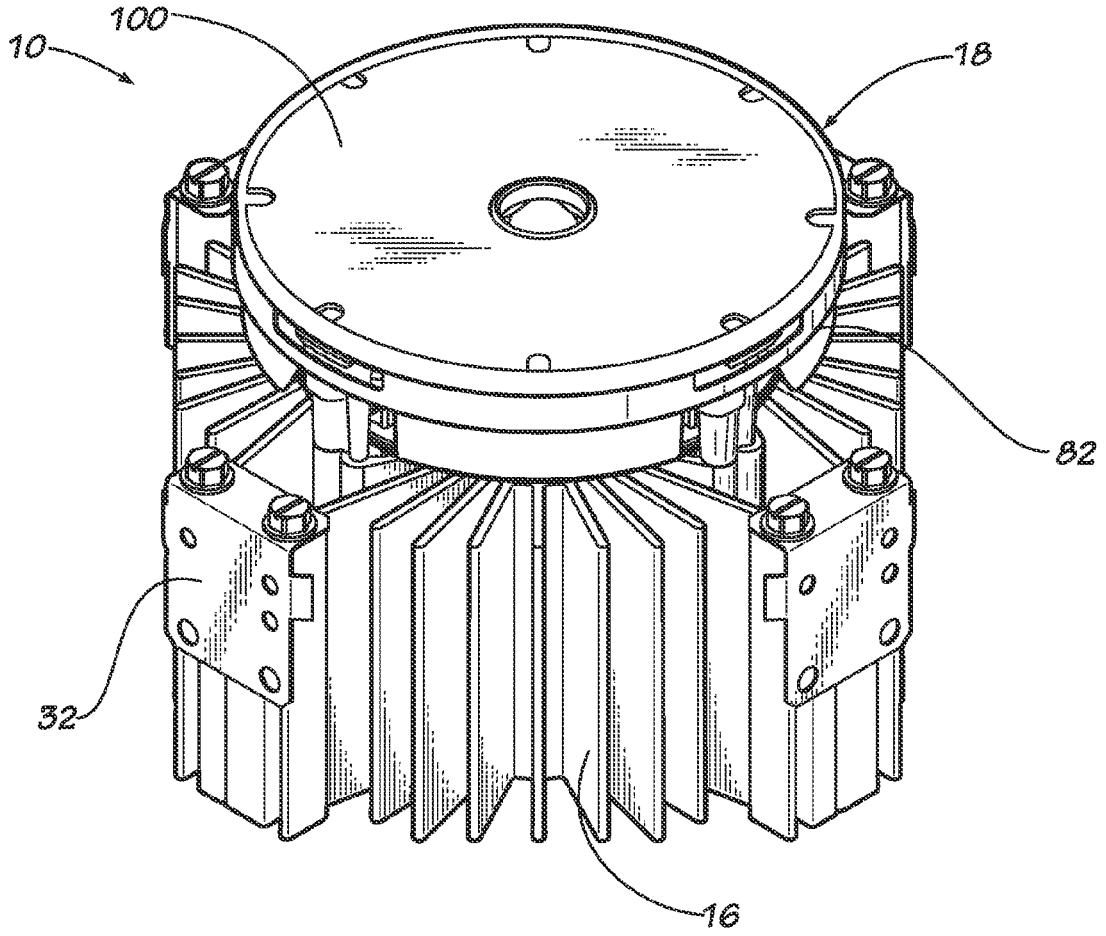
FIG. 1. is a top perspective view of an embodiment of a light engine.
Figure 2:
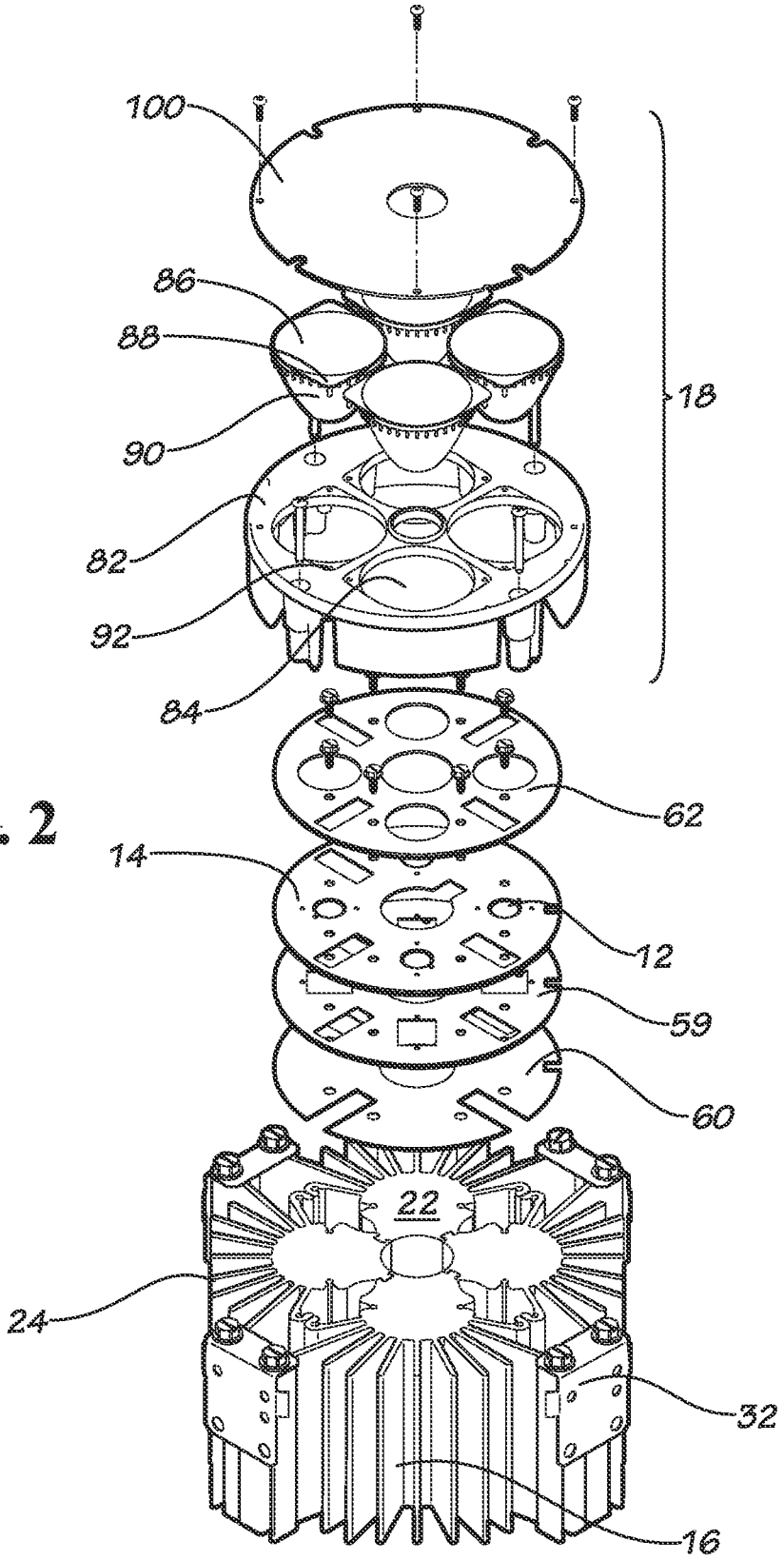
FIG. 2 is an exploded view of the light engine of FIG. 1.
Figure 3B:
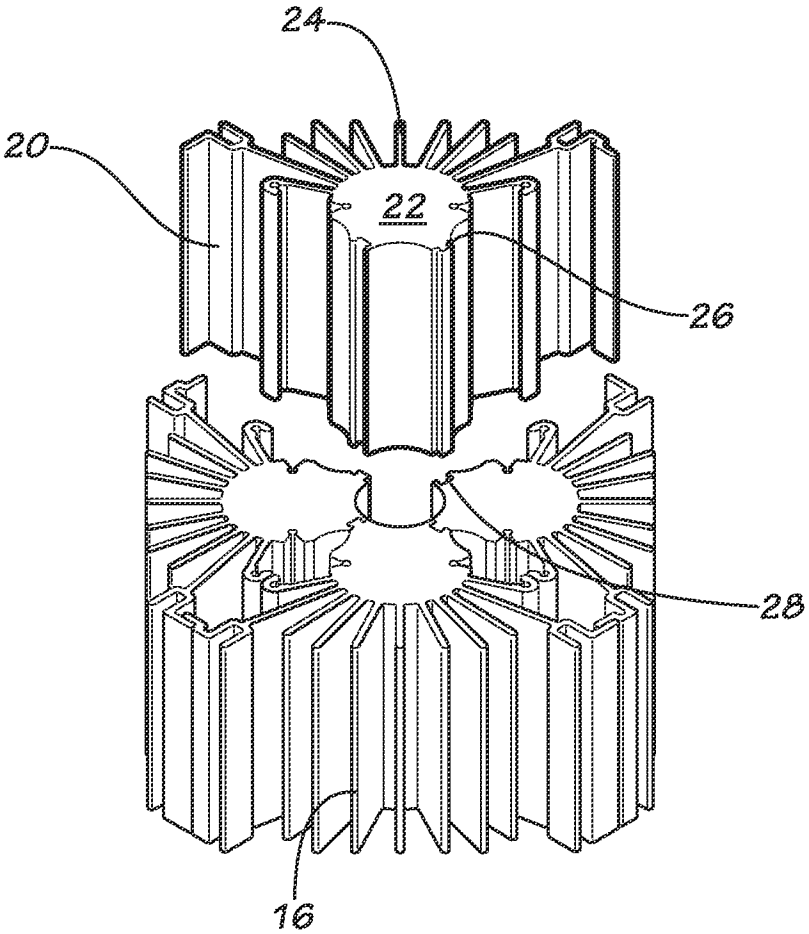
FIGS. 3*a*-3*f* show various views of embodiments of heat sinks for use with the light engines contemplated herein.
Figure 3A:
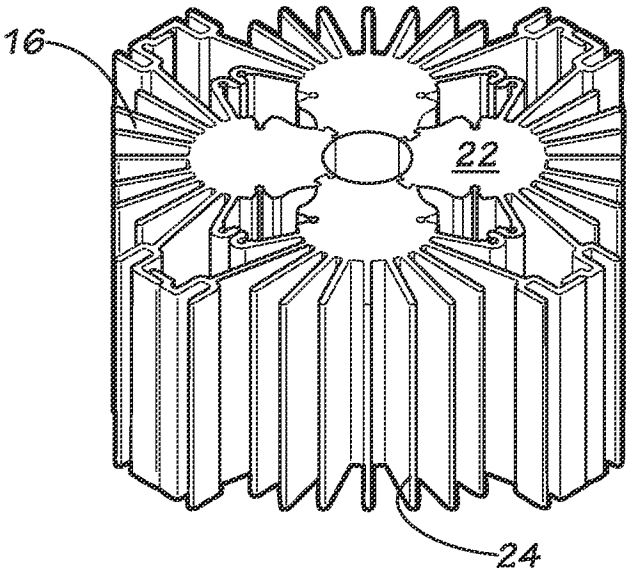
Figure 3D:
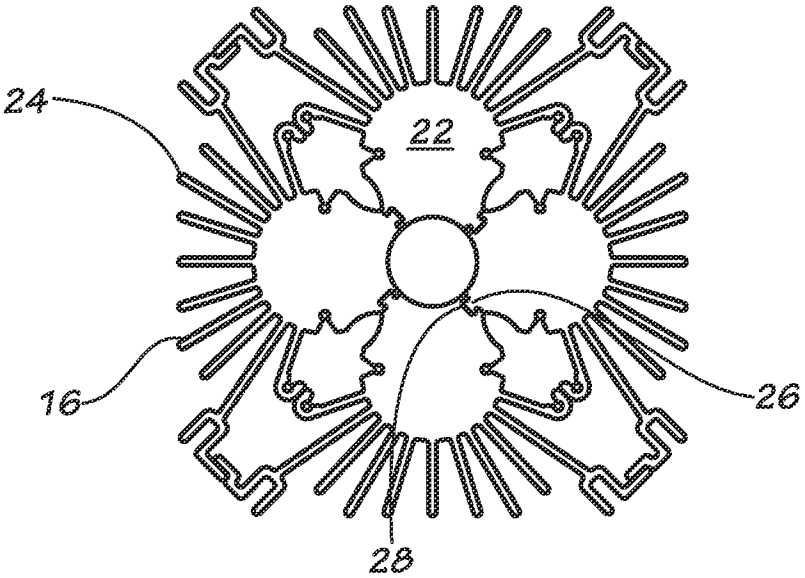
Figure 3C:
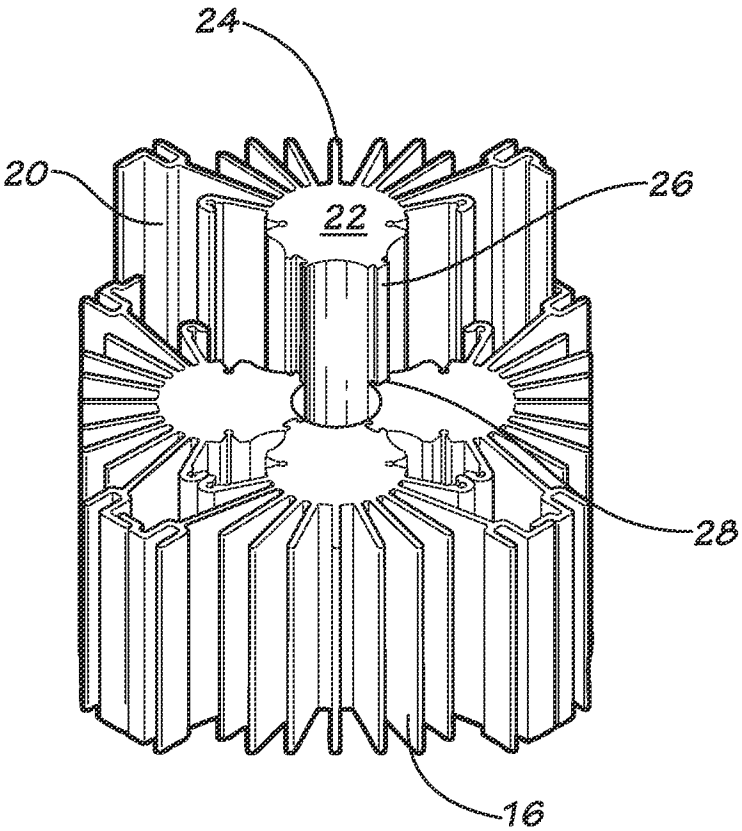
Figure 3F:
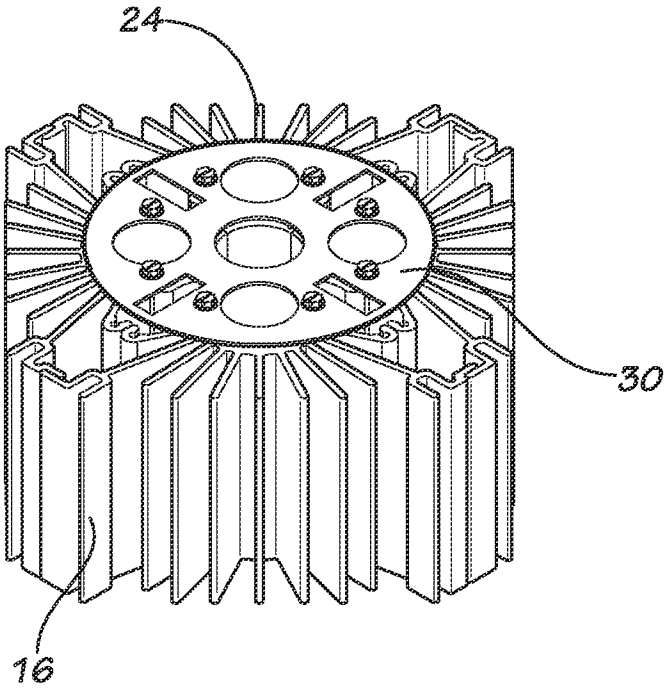
Figure 3E:
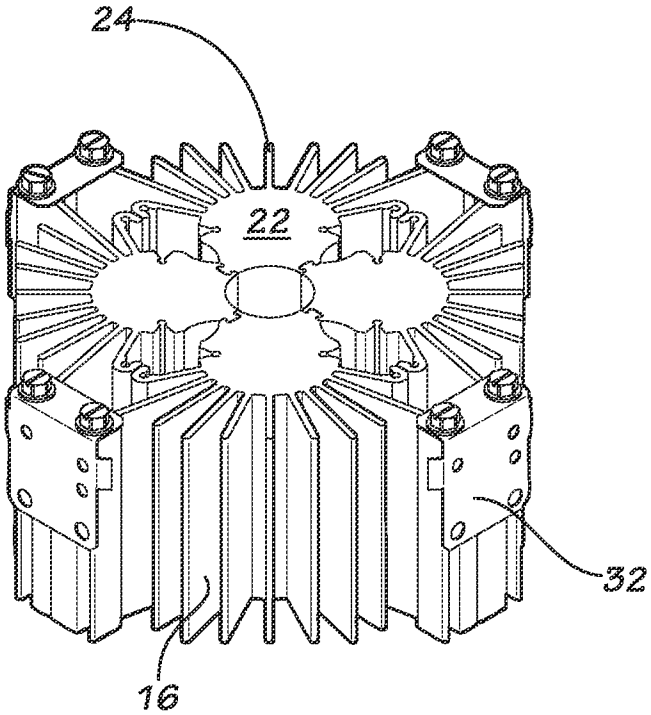
Figure 4C:
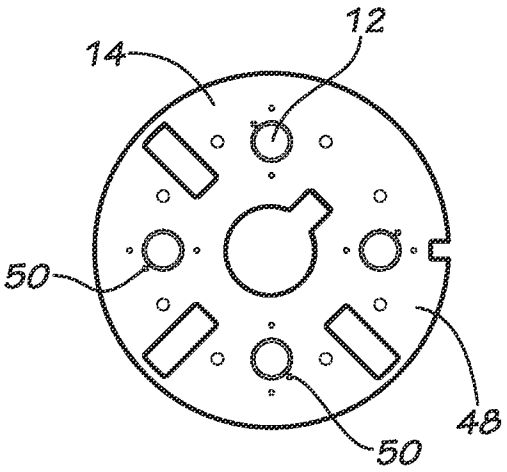
FIGS. 4*a*-4*c* show various views of an embodiment of a printed circuit board for use with light engines contemplated herein.
Figure 4B:
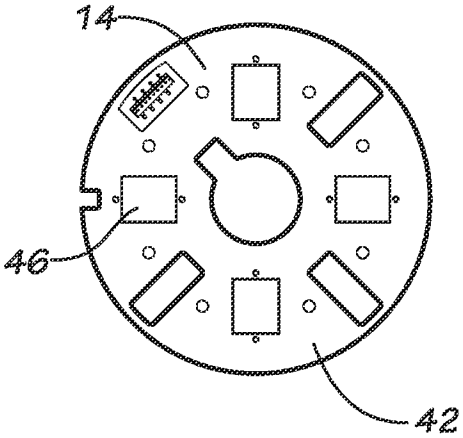
Figure 4A:
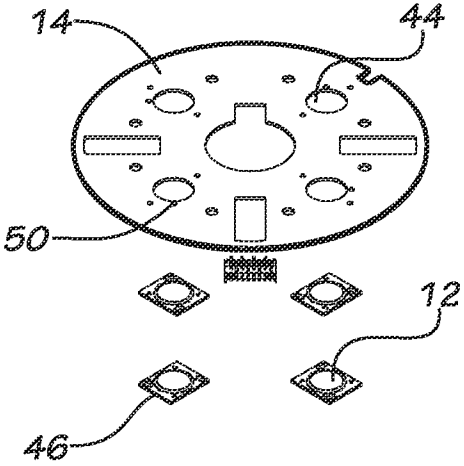
Figure 4D:
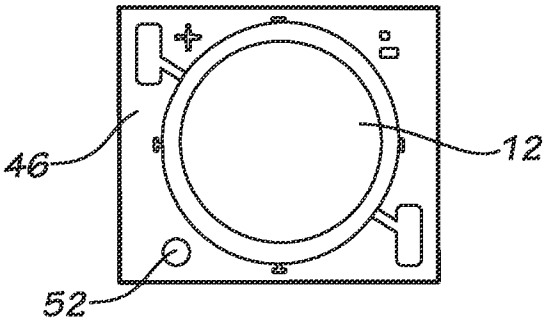
FIG. 4*d* is a top plan view of an embodiment of an LED chip.

Embodiments of the light engine 10 (one embodiment of which is shown assembled in FIG. 1 and exploded in FIG. 2) include light emitting diodes 12 ("LEDs") mounted on a printed circuit board ("PCB") 14, which in turn is attached to a heat sink 16. Finally, an optic assembly 18 is positioned over the PCB 14 and attached to the heat sink 16 to direct the emitted light as desired.

While embodiments of the heat sink 16 may be an integrally-formed structure, the heat sink 16 may also be formed of independent heat sink sections 20 that are assembled together to form the heat sink 16 (see FIGS. 3*a*-3*f*). In one embodiment, each heat sink section 20 includes a heat tower 22 with fins 24 radiating therefrom. However, other heat sink configurations are certainly contemplated herein. The heat sink 16 may be formed of any number of heat sink sections 20. The heat sink sections 20 can be secured together via mechanical interlock (e.g., tongue 26 and groove 28 interlock, as shown in FIGS. 3*a*-3*e*) and/or via a plate 30 (FIG. 3*f*) and/or one or more brackets 32 (FIG. 3*e*) that span, and are secured to, adjacent heat sink sections 20 to hold them together. However, other means for securing the heat sink sections 20 together would be obvious to one having ordinary skill. in the art and are certainly contemplated herein.

In some embodiments, the LEDs 12 are provided on the PCB 14 using a standard SMT process with the parts inverted. The traces (not shown) are provided on the rear face 42 of the PCB 14 so as to be protected when the PCB 14 is mounted to the heat sink 16 (see FIG. 4*b*). The PCB 14 includes chip apertures 44 for receiving the LED chips 46, which contain the LEDs 12 (see FIG. 4*a*). Any number of LED chips 46 may be provided on the PCB 14. The LED chips 46 are mounted to the rear face 42 of the PCB 14 (seen in FIG. 4*b*) so as to partially extend through and reside in the chip apertures 44 (see FIG. 4*c*). In some embodiments, the LED chips 46 are soldered to the rear face 42 of the PCB 14. The LEDs 12 are positioned to emit light from the front face 48 of the PCB 14 opposite the rear face 42 of the PCB 14 where the electrical connections are made. As shown in FIGS. 4*a*-4*d*, an alignment hole 50 may be provided on the PCB 14 adjacent the chip apertures 44 to indicate when an LED chip 46 has been properly oriented within a chip aperture 44. By way only of example, an alignment indicator 52 may be provided on the LED chip 46 such that proper alignment of the LED chip 46 relative to the PCB 14 is assured when the alignment indicator 52 on the LED chip 46 is visible in the alignment hole 50 of the PCB 14.

Figure 5A:
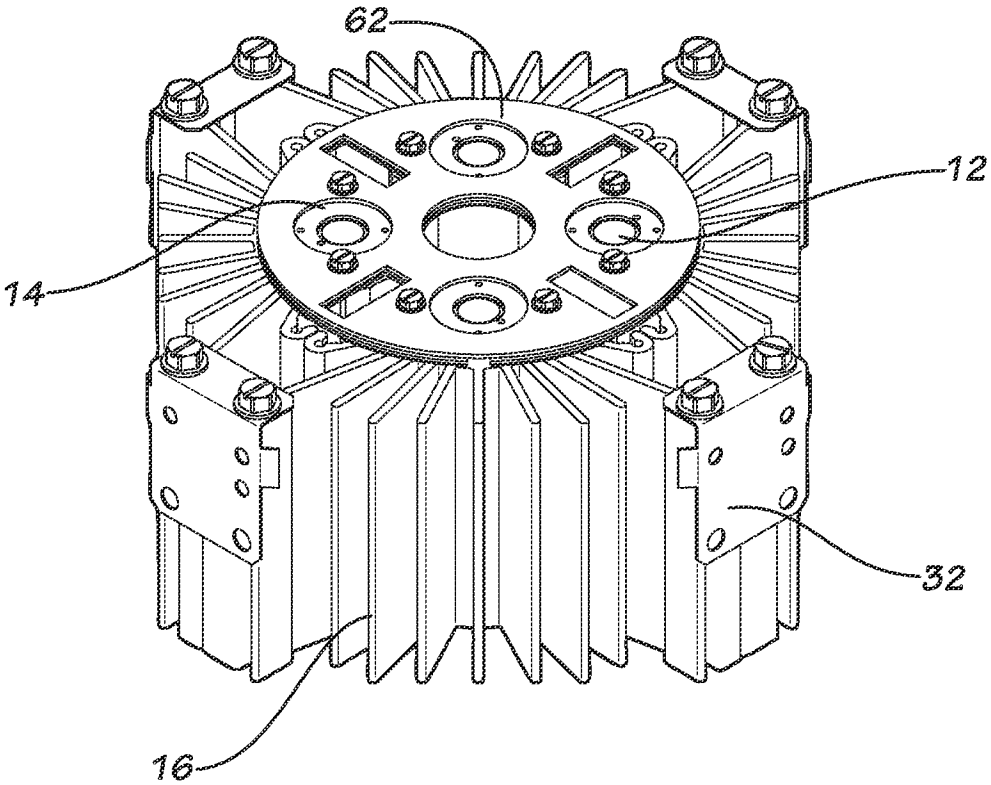
FIG. 5*a* is a top perspective view of a partially assembled light engine according to one embodiment.
Figure 5B:
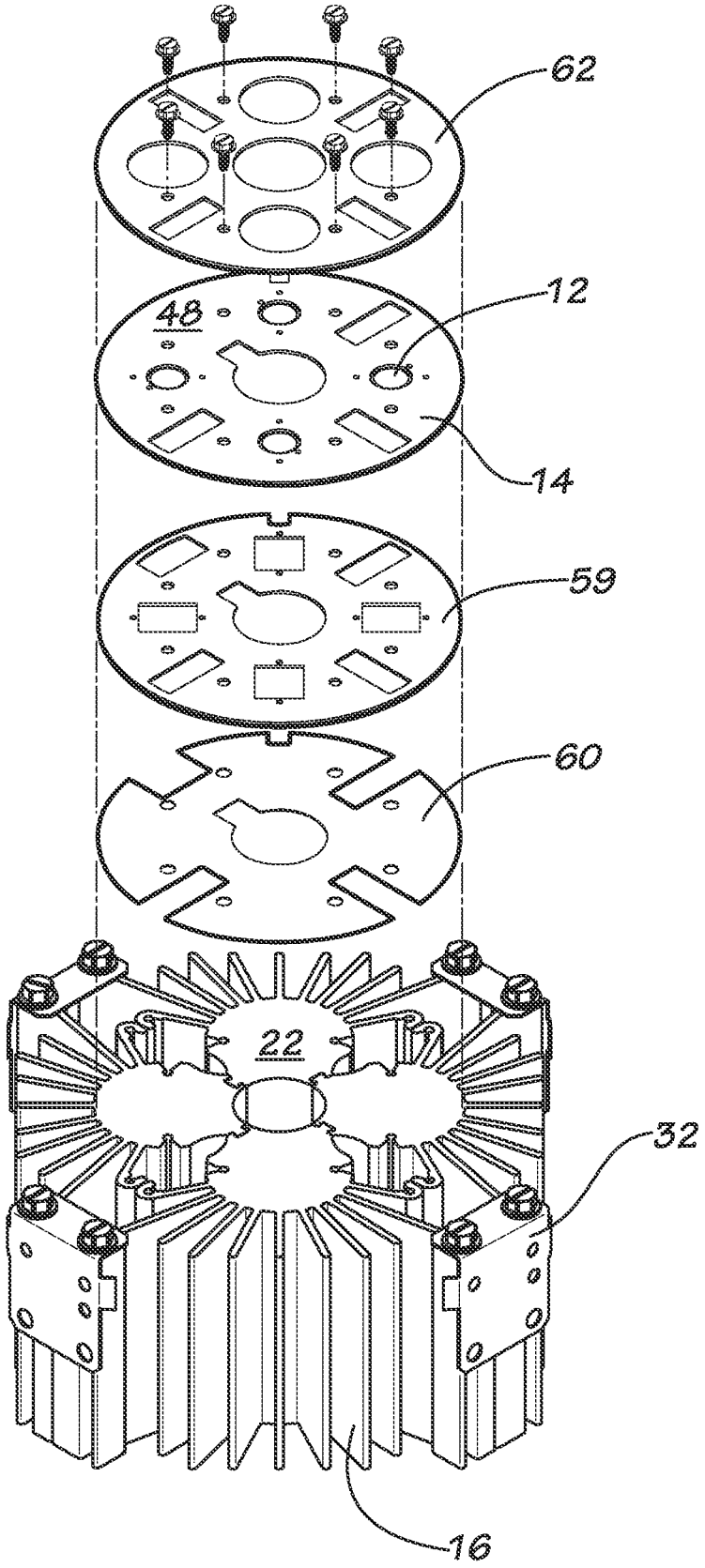
FIG. 5*b* is an exploded view of the partially assembled light engine shown in FIG. 5*a*.

The PCB 14 (with associated LED chips 46) is mounted onto the heat sink 16 using any type of suitable mechanical retention methods (e.g., screws or other fasteners as shown in FIG. 5*a*. In some embodiments, a spacer 59 and/or thermal interface material 60 may be, but do not have to be, interposed between the heat sink 16 and PCB 14, as seen in FIG. 5*b*. A protective plate 62 may be, but does not have to be, positioned over the front face 48 of the PCB 14. In some embodiments, the heat sink 16 includes an upraised key (not shown). Indicia (such as notches) may be provided on the spacer 59 thermal interface material 60, PCB 14, and/or protective plate 62 to engage the key and ensure their proper alignment with respect to each other and the heat sink 16. In some embodiments, the number of heat towers 22 provided in the heat sink 16 corresponds to the number of LED chips 46 provided on the PCB 14. In this way, the PCB 14 may be attached to the heat sink 16 so that the LED chips 46 are positioned. over the heat towers 22. However, such a configuration is certainly not required.

Figure 6A:
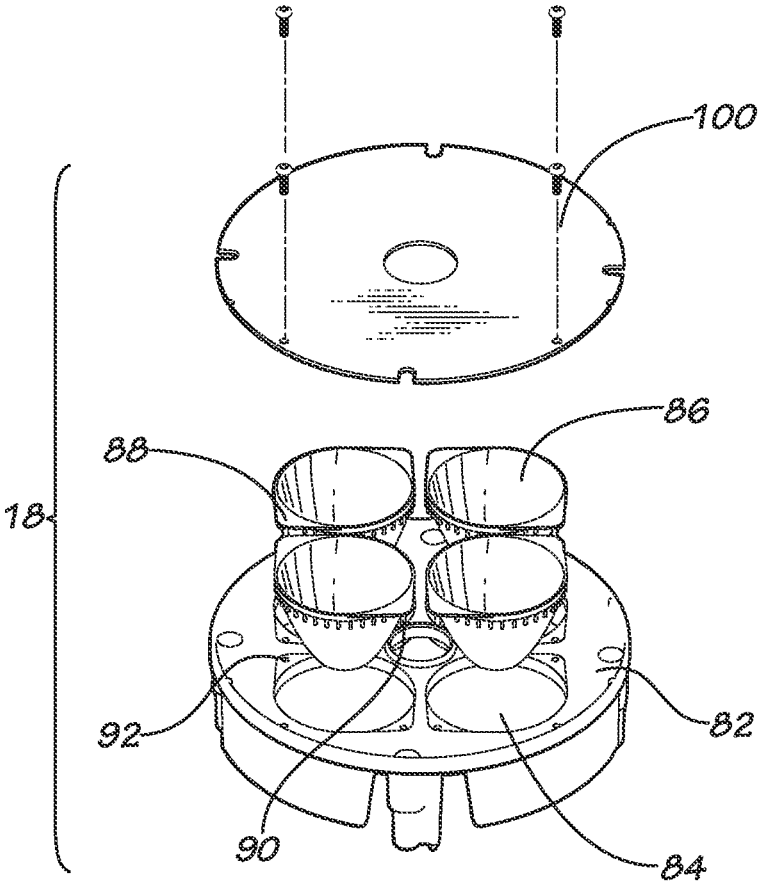
FIG. 6*a* is an exploded view of an embodiment of an optical assembly for use with the light engines contemplated herein.
Figure 6B:
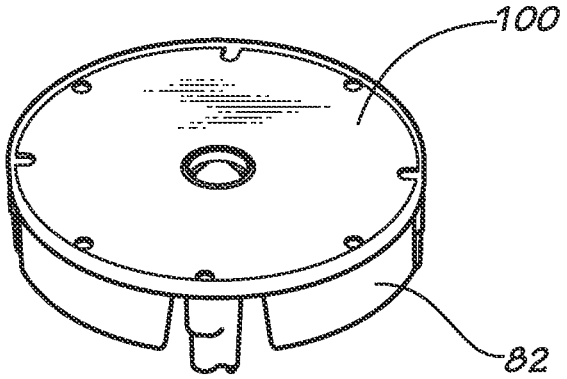
FIG. 6*b* is a top perspective view of the optical assembly of FIG. 6*a* assembled.

Embodiments of the optic assembly 18 include an optic retainer 82 having one or more reflector receivers 84 for supporting one or more reflectors 86. See FIG. 6*a*, Any number of reflectors 86 and thus reflector receivers 84 may be used. The reflectors 86 may be retained within the reflector receivers 84 on the optic retainer 82 by any of a plurality of methods, including using mechanical fasteners (e.g., screws, clips, etc.) to secure the reflectors 86 to the optic retainer 82. In one embodiment, each reflector 86 includes wings 88 with a mounting pin 90 extending downwardly from each wing 88. When a reflector 86 is properly positioned and aligned within a reflector receiver 84 on the retainer 82, the pins 90 of the wings 88 engage apertures 92 in the retainer 82. The pins 90 can be, but do not have to be, heat staked (i.e., deformed by heat) to thereby retain the reflectors 86 on the optic retainer 82.

In some embodiments, the optic assembly 18 includes one or more lenses 100 that are retained over the face of the optic retainer 82. In. one embodiment (see FIGS. 7*a*. and 7*b*), a retaining band 102 is retained on the optic retainer 82 over the lens 100. The retaining band 102 may be held on the optic retainer 82 via conventional mechanical fasteners or may be snap-fitted onto the optic retainer 82. In yet other embodiments, the lens(es) 100 is secured to the optic retainer 82, such as via screws, screws clips, springs or other fasteners. In such embodiments, it may not be necessary to independently secure each reflector 86 to the optic retainer 82, as discussed above. Rather, the lens(es) 100 may hold the reflectors 86 in place on the optic retainer 82 without them being directly secured to the optic retainer 82. Various optical enhancements and accessories to adjust the light beam for desired effect, such as spread lens, linear lines, prismatics, color effects as well as others, may be mounted on the optic assembly 18, such as by screwing them onto the optic retainer 82 or by attaching them using a retaining band 102.

Figure 8:
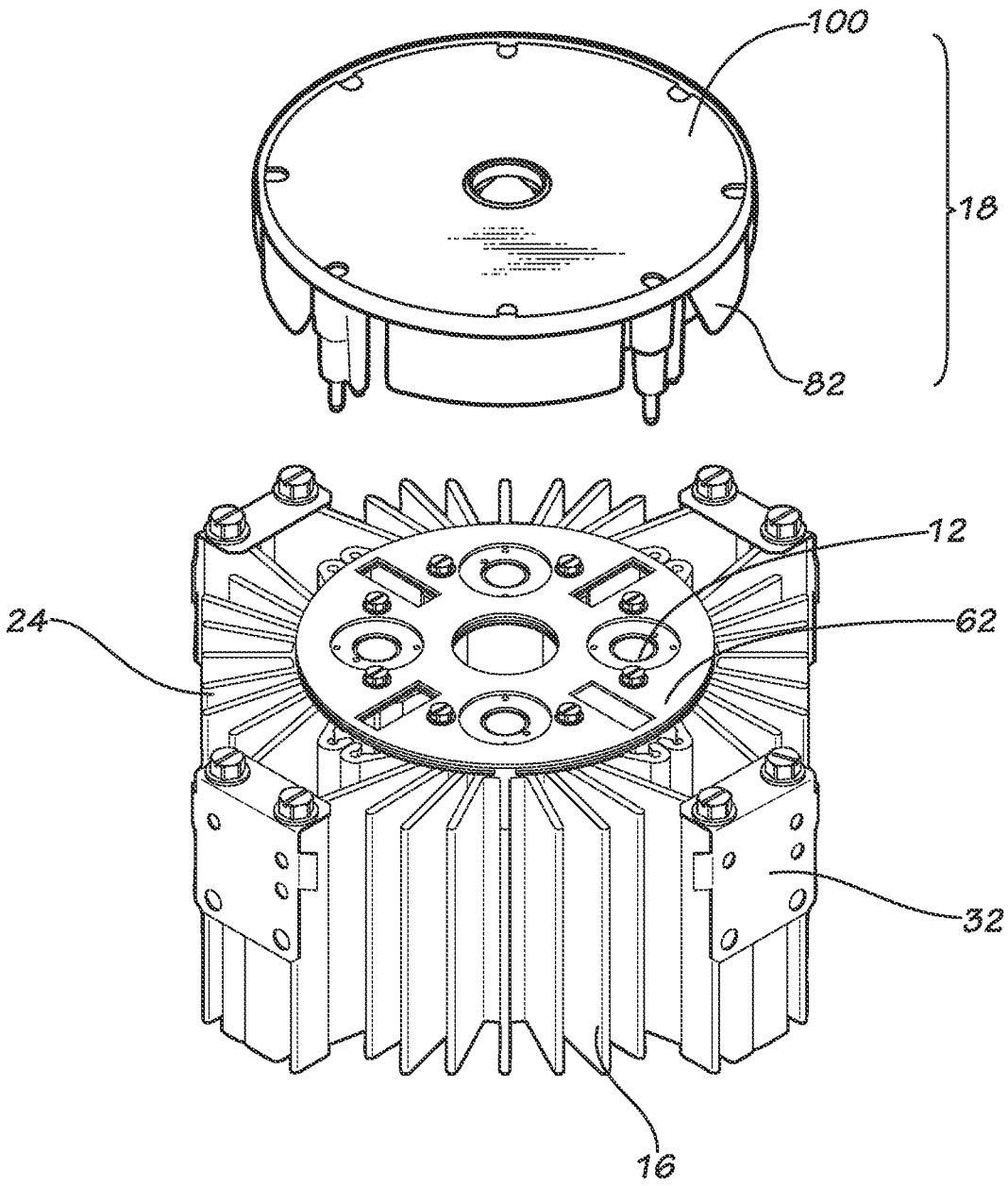
FIG. 8 is an exploded view of an embodiment of a light engine.
Figure 9A:
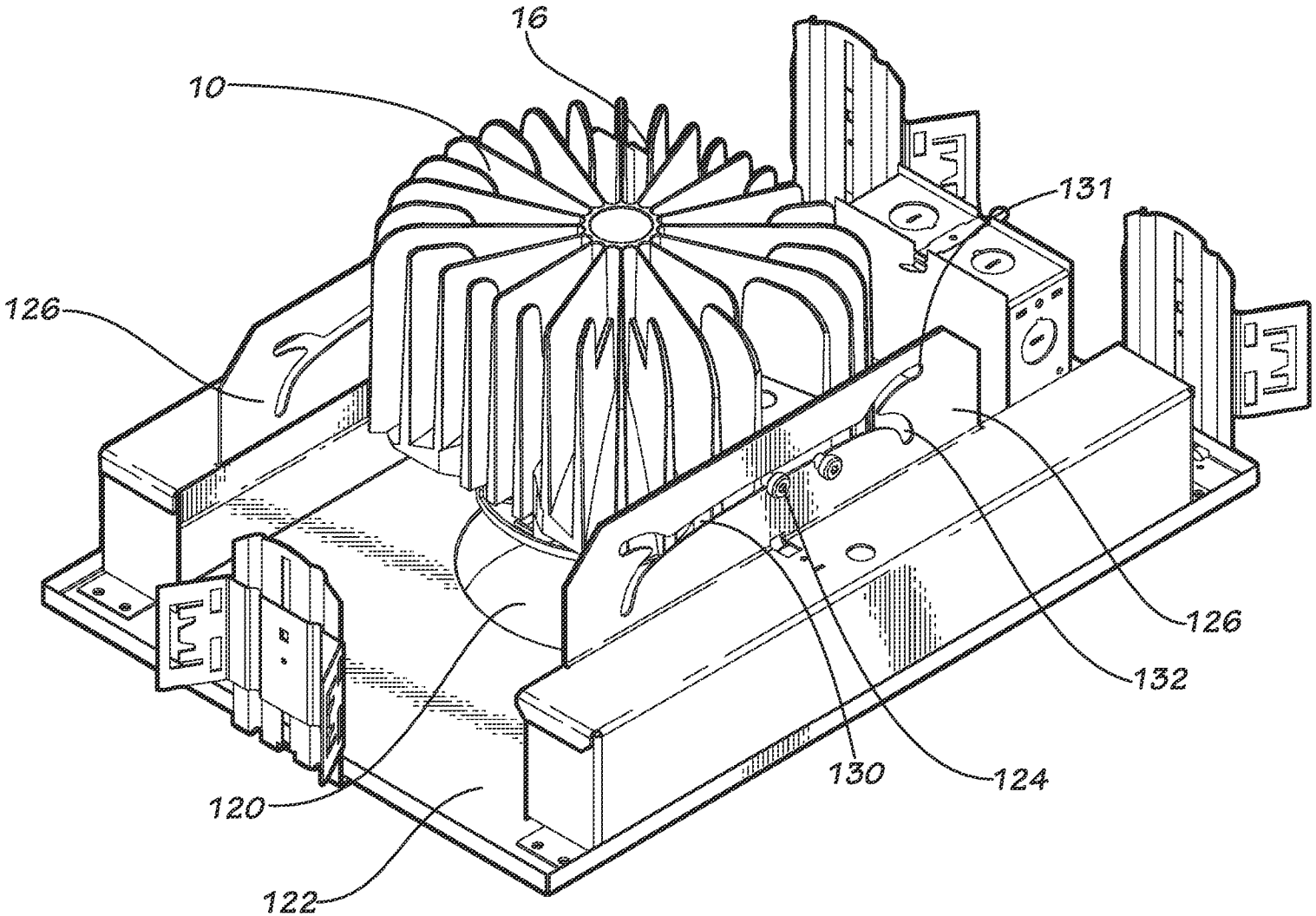
FIGS. 9*a*, 9*b*, 10*a*, 10*b*, 11*a*, and 11*b* show various embodiments of light engines positioned over and moved relative to a mounting frame opening.
Figure 9B:
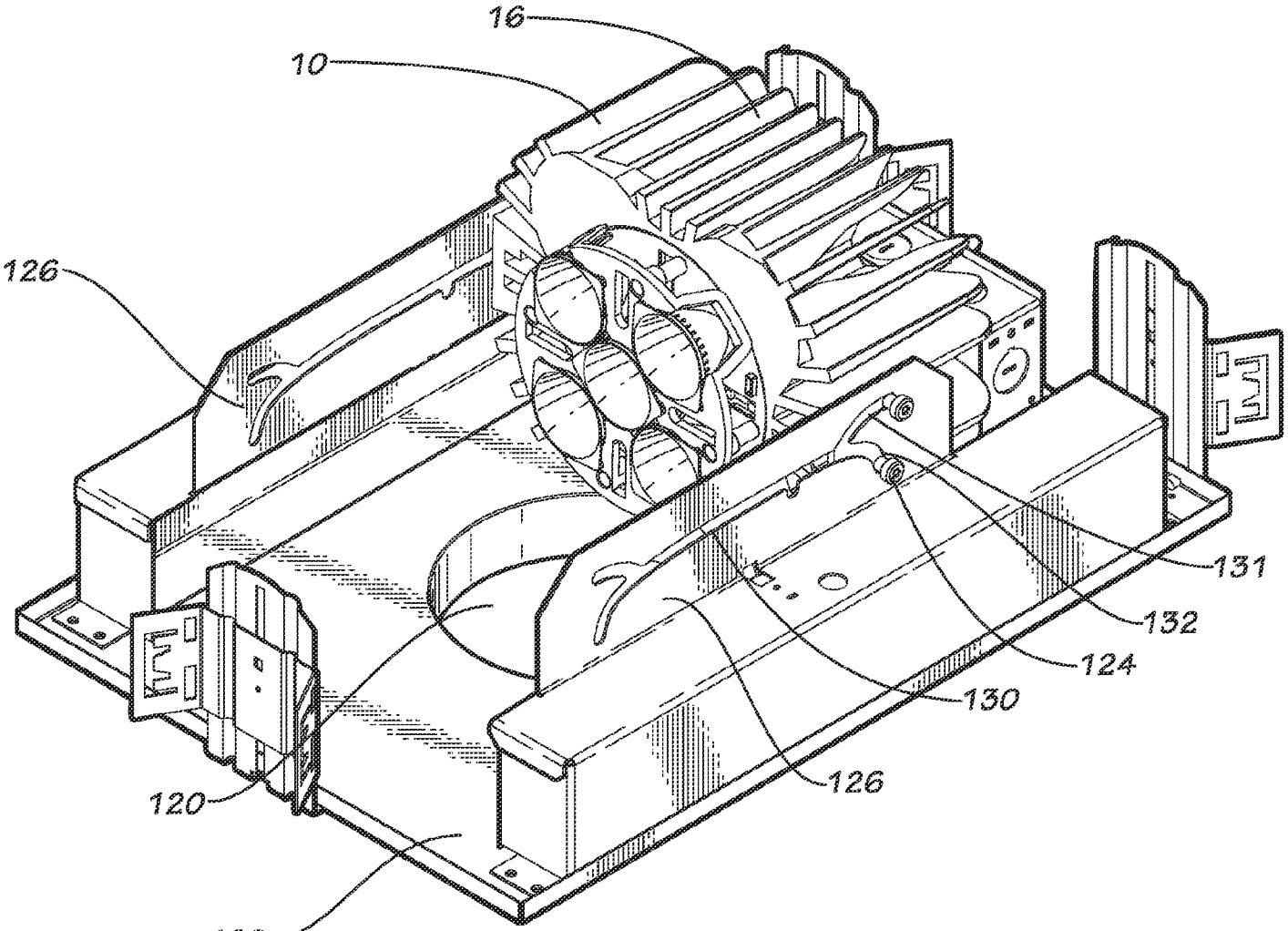

The optic assembly 18 is positioned and mounted on the heat sink 16 so that each reflector 86 aligns with the LEDs 12 on the PCB 14 (see FIG. 8). Some embodiments of the optic assembly 18 allow for quick and easy customization of the light distribution emitted from the light engine 10. More specifically and in some embodiments, by simply removing the lens(es) 100 from the optic retainer 82, some or all of the reflectors 86 may easily be removed from the optic retainer 82 and substituted with reflectors 86 having different optical properties. So too can the lense(s) 100 be removed and substituted with lens(es) 100 having different optical properties. In some embodiments, a 20-70 degree beam angle distribution can be achieved by mixing and matching a minimal number of different reflectors 86 and lens 100 combinations.

The light engine 10 is positioned within the ceiling within the opening 120 of a mounting frame 122. In some embodiments, at least one pin 124 extends from opposing sides of the heat sink 16. See generally FIGS. 9*a*-*b*, 10*a*-*b*, and 11*a*-*b*. While a single pin 124 could extend from each side of the heat sink 16, for illustrative purposes two pins 124 are discussed and shown as extending from each side of the heat sink 16. In use, the heat sink 16 engages opposing upright supports 126 on the mounting frame 122. More specifically, the pins 124 engage an elongated slot 130 provided in each upright support 126. The pins 124 are able to translate within the slots 130 and thereby permit the light engine 10 to be moved clear of the mounting frame opening 120 (as shown in 9*a*-*b*, 10*a*-*b*, and 11*a*-*b*) to permit the wire connections in the junction box and the LED driver/power supply to be serviced from below without having to access the space above the ceiling.

Various slot geometries are contemplated herein. Both unidirectional and bi-directional longitudinal translation of the light engine 10 relative to the mounting frame opening 120 is contemplated herein. In some embodiments, the geometry of the slot 130 can enable hi-directional longitudinal translation of the light engine 10 as well as rotational tilting of the light engine 10. For example, the slot 130 may have a length sufficient to permit the light engine 10 to translate to the left and right of the mounting frame opening 120.

The slot path can curve at one or both of its ends to effectuate tilting of the light engine 10 as the pins 124 follow the curved path. In the illustrated embodiment of FIGS. 9*a* and 9*b*, the slot path splits and includes a upwardly curved portion 131 and a downwardly curved portion 132, each for accommodating one of the pins 124. However, the number and geometry of the curved portions may change depending on the number of pins 124 extending from the heat sink 16 as well as the desired degree of tilt.

Figure 10A:
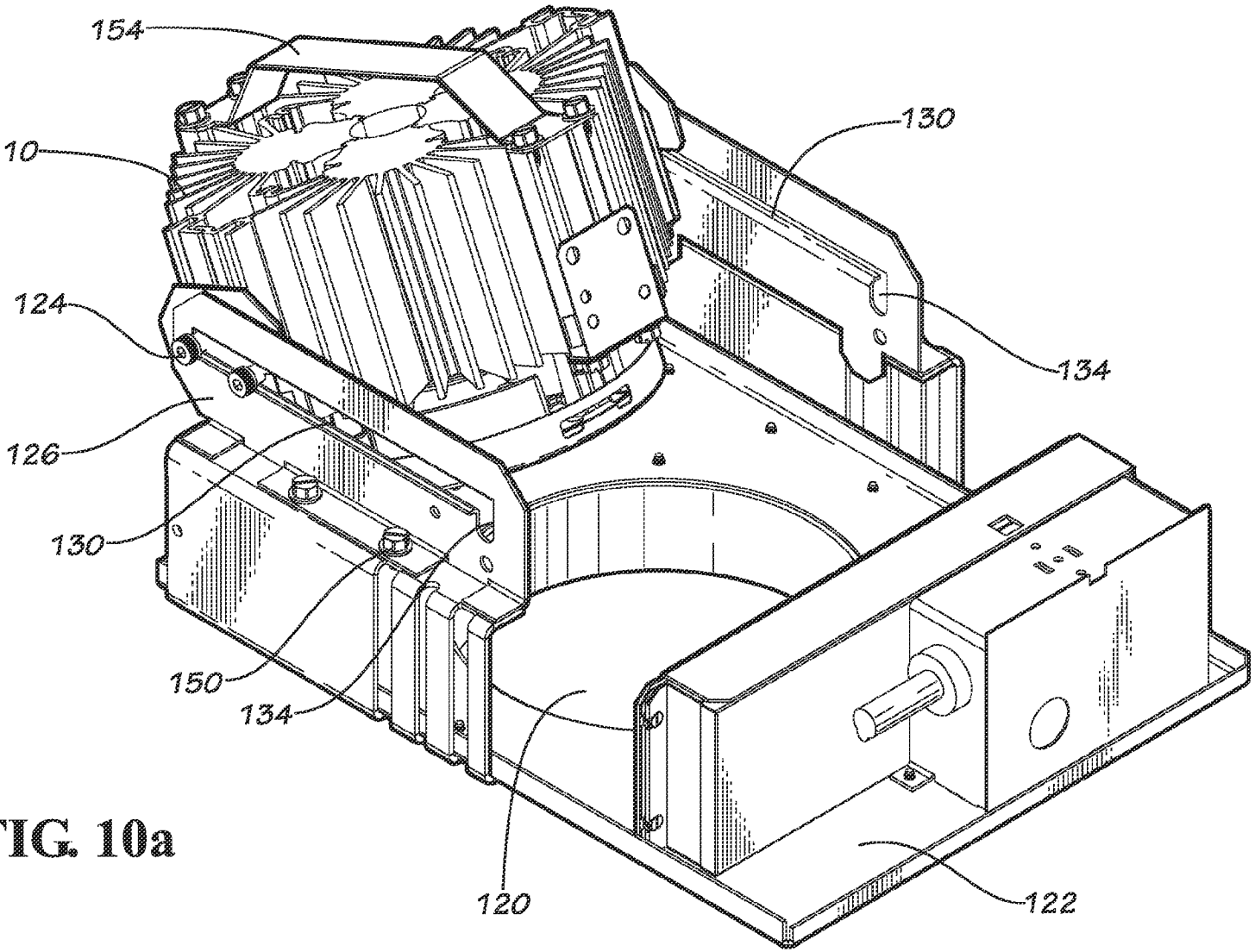
Figure 10B:
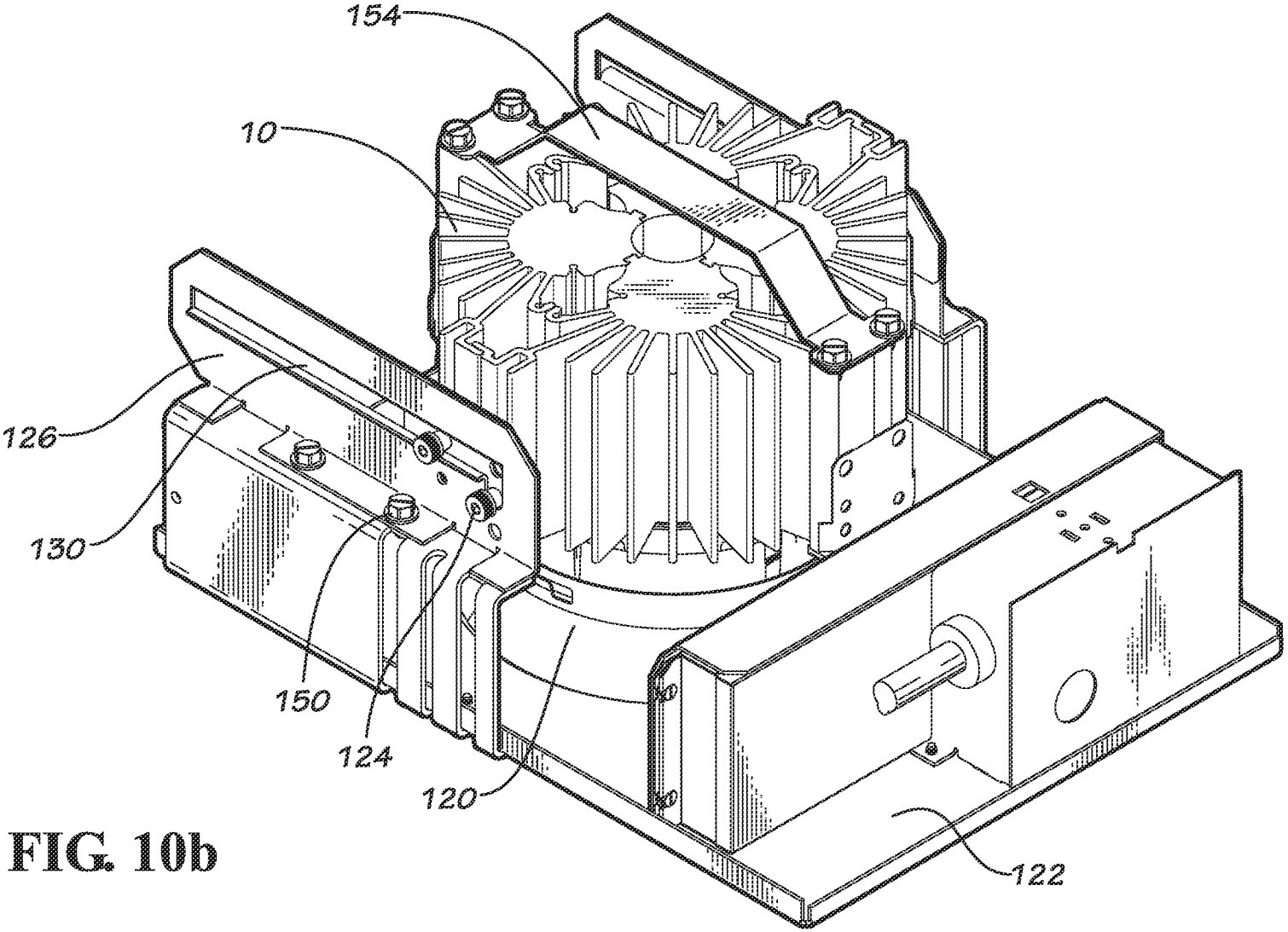

In one embodiment (see FIGS. 10*a* and 10*b*), the slot 130 is substantially straight but includes a. detent 134 on at least one end of the slot 130. Note that while FIGS. 10*a* and 10*b* show a detent 134 on only one end of the slot 130, a detent 134 could be provided on both ends of the slot 130 so that the light engine 10 can move in both directions along the slot 130 (similar to the embodiment shown in FIGS. 9*a* and 9*b*).

In some embodiments, the pins 124 that extend from each side of the heat sink 16 are not laterally aligned, but rather one pin 124 is located slightly lower on the heat sink 16 than another pin 124. When the pins 124 are in the straight portion of the slot 130 (see FIG. 10*a*), the light engine 10 is angled slightly (by virtue of the pin offset) and is movable along the slot 130 to move the light engine 10 out of the way of the frame opening 120. To lock the light engine 10 in place over the frame opening 120 during normal use, the pin 124 positioned lower on the heat sink 16 engages the detent 134. See FIG. 10*b*. This levels the light engine 10 and prevents its movement. To move the light engine 10 out of the way again, the lowermost pin 124 is simply disengaged from the detent 134 and the light engine 10 can be moved as described above.

Figure 11A:
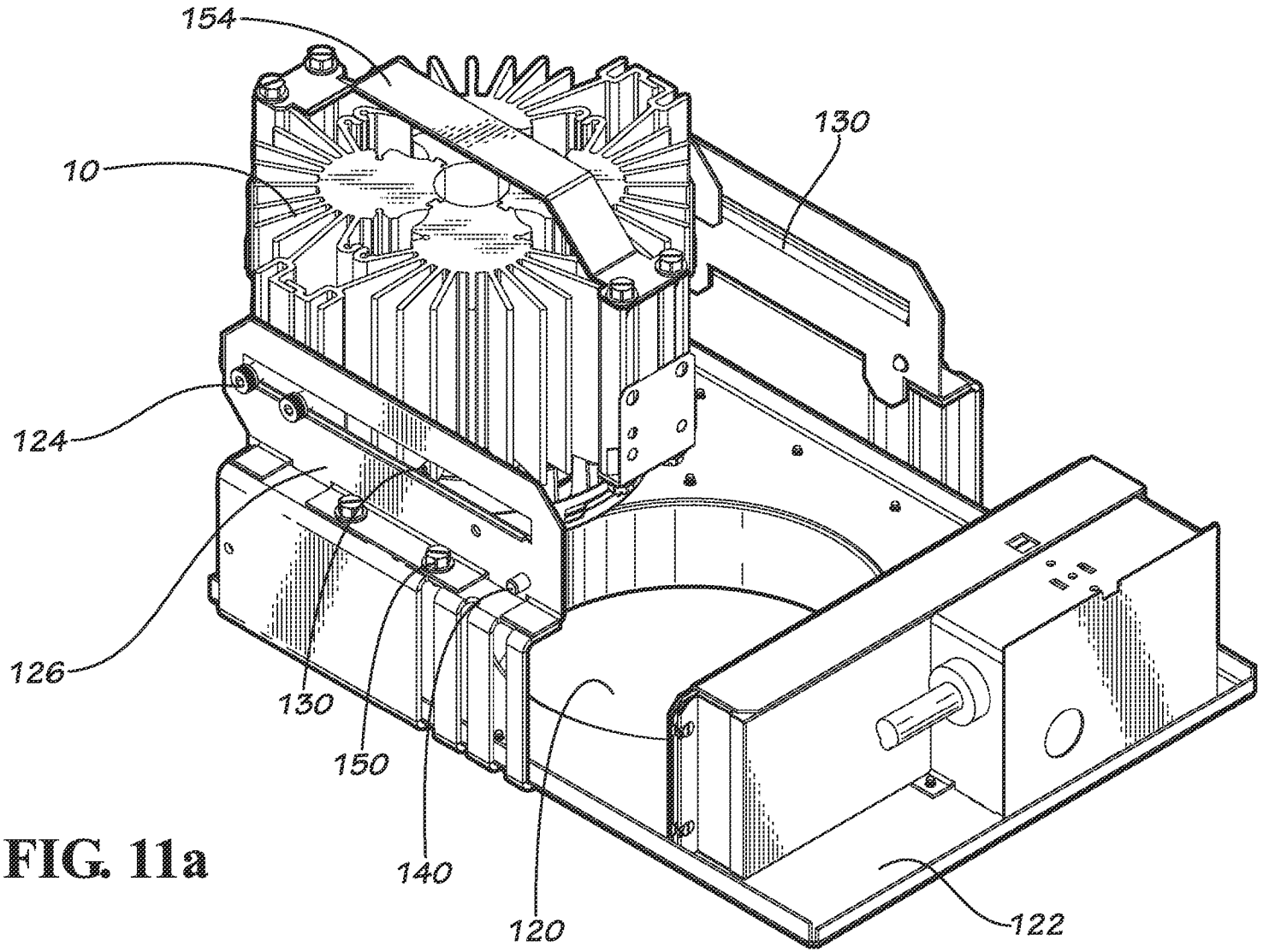
Figure 11B:
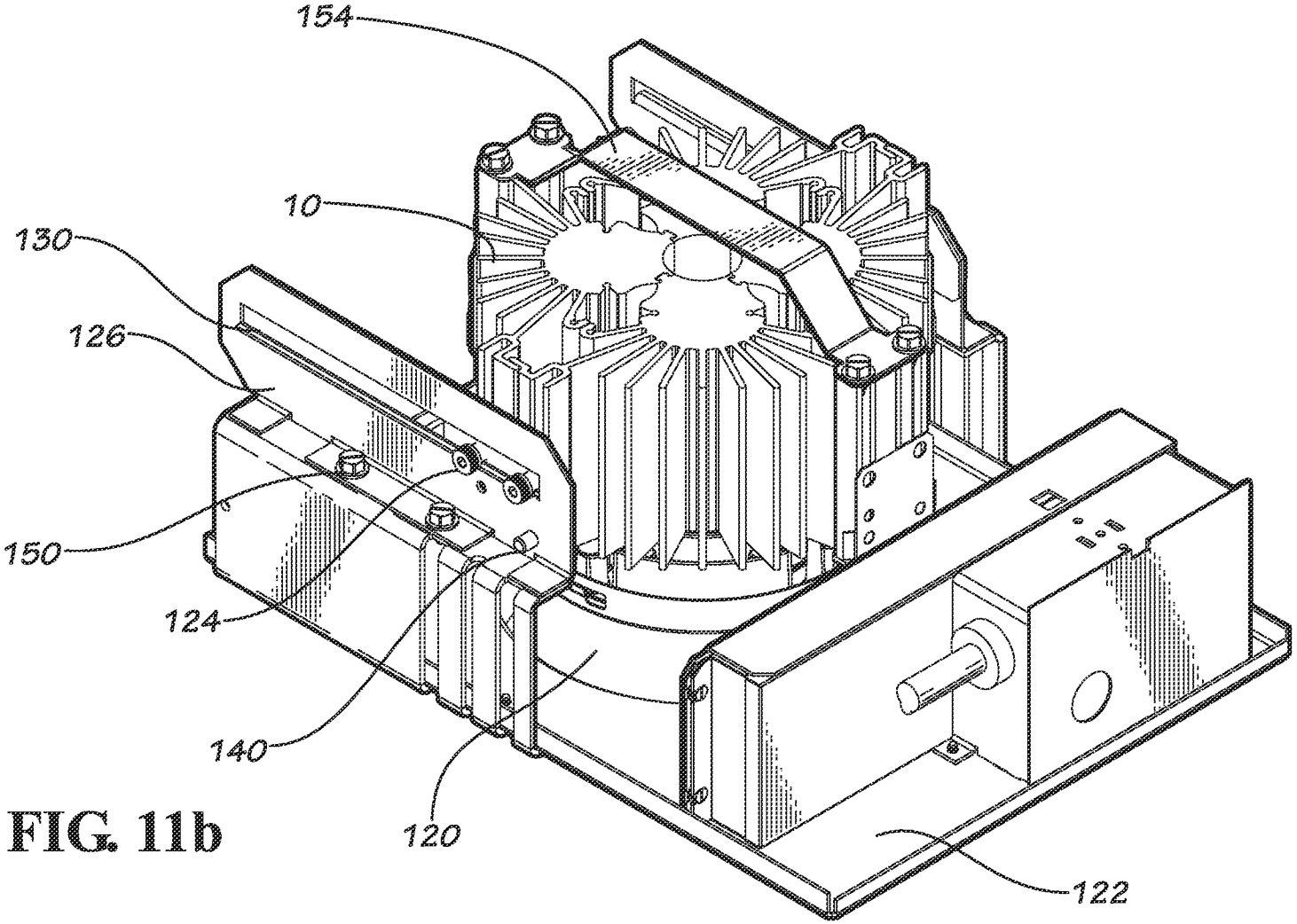

In other embodiments, the slot 130 does not have a detent(s), as seen in FIGS. 11*a* and 11*b*. Rather, the light engine 10 is translated using a slot 130 without a detent 134 to move it clear of the mounting frame opening 120. in this case, the pins 124 that extend from each side of the heat sink 16 are laterally aligned, and the light engine 10 does not tilt. It may be desirable to lock the light engine 10 in position. over the mounting frame opening 120. By way only of example, a spring loaded detent 140 extending from each. upright support 126 (seen in FIG. 11*b*) can engage an aperture provided on the light engine 10 (such as on the heat sink 16 or on structure (e.g., the brackets 32 of FIG. 3*e*) mounted to the heat sink 16) to positively lock the light engine 10 in position relative to the upright supports 126 and thus the mounting frame opening 120.

In certain circumstances, it may be desirable to service the light engine 10 from above the ceiling, in which case it may be necessary to remove the light engine 10 from its position over the mounting frame opening 120. In some embodiments, this may be done by disengaging from the heat sink 16 the pins 124 that extend through the slots 130 in the upright supports 126. This would allow the light engine 10 to be maneuvered for servicing. In another embodiment, the pins 124 remain engaged. in the slots 130 and the upright supports 126 are disengaged from the mounting frame 122. For example, the upright supports 126 may be secured to the mounting frame 122 with screws 150. The screws 150 may simply be removed to permit the light engine 10 with associated upright supports 126 to be maneuvered for servicing. To facilitate handling of the light engine 10 from above, a handle 154 may be mounted to the heat sink 16.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

We claim:

1. A lighting system comprising a. light engine comprising:

i. a heat sink, ii. a first pin extending from a first side of the heat sink and a second pin extending from a second side of the heat sink opposite the first side;

iii. a printed circuit board comprising a front face and a rear face, wherein the printed circuit board is mounted on the heat sink such that the rear face of the printed circuit board faces the heat sink;

iv. a plurality of light emitting diodes mounted on the printed circuit board to emit light from the front face of the printed circuit board; and v. an optical assembly comprising at least one reflector, wherein the optical assembly is positioned on the heat sink so that the at least one reflector at least partially surrounds at least one of the plurality of light emitting diodes;

b. a mounting frame having a mounting frame opening; and c. a first upright support extending upwardly from the mounting frame on a first side of the mounting frame opening and a second upright support extending upwardly from the mounting frame on a second side of the mounting frame opening opposite the first side, wherein the first and second upright supports each comprises an elongated slot and wherein at least one of the first upright support and the second upright support comprises a locking structure, wherein the light engine is adapted to be positioned over the mounting frame opening so that light from the plurality of light emitting diodes is emitted through the mounting frame opening, wherein the first pin engages the elongated slot of the first upright support and the second pin engages the elongated slot of the second upright support, wherein the first and second pins are configured to translate within the elongated slots so that the light engine can move between a first position over the mounting frame opening to a second position removed from the mounting frame opening, and wherein the light engine and the locking structure on the at least one of the first upright support and the second upright support engage when the light engine moves into the first position to automatically lock the light engine in the first position.

2. The lighting system of claim 1, wherein the light engine further comprises a third pin extending from the first side of the heat sink and laterally offset from the first pin and a fourth pin extending from the second side of the heat sink and laterally offset from the second pin, wherein the third pin engages the elongated slot of the first upright support and the fourth pin engages the elongated slot of the second upright support.

3. The lighting system of claim 1, wherein at least a portion of at least one elongated slot is curved.

4. The lighting system of claim 1, wherein the upright supports are attached to the mounting frame by at least one removable mechanical fastener.

5. The lighting system of claim 1, wherein the light engine further comprises a handle attached to the heat sink.

6. The lighting system of claim 1, wherein the locking structure on the at least one of the first upright support and the second upright support comprises a detent defined in an end of the elongated slot of each of the first and second upright supports and wherein, when the light engine moves into the first position over the mounting frame opening, the first pin seats in the detent of the elongated slot of the first upright support and the second pin seats in the detent of the elongated slot of the second upright support so as to automatically lock the light engine in the first position.

7. The lighting system of claim 1, wherein the locking structure on the at least one of the first upright support and the second upright support comprises a spring-loaded detent that engages the light engine when the light engine moves into the first position so as to form a snap-fit connection with the light engine and so as to automatically lock the light engine in the first position.

* * * * *